US005457262A

United States Patent [19]

Huang et al.

[11] Patent Number: 5,457,262

[45] Date of Patent: Oct. 10, 1995

[54] PREPARATION OF INORGANIC HARDENABLE SLURRY AND METHOD FOR SOLIDIFYING WASTES WITH THE SAME

[75] Inventors: Ching-Tsven Huang, Lung-Tan; Wen-Yi Yang, Ping Chen City, both of Taiwan

[73] Assignee: Institute Of Nuclear Energy, Taiwan

[21] Appl. No.: 121,885

[22] Filed: Sep. 17, 1993

[51] Int. Cl.[6] ..... G21F 9/00

[52] U.S. Cl. ..... 588/3; 588/4; 588/252; 106/628; 106/717; 106/782; 106/815

[58] Field of Search ..... 588/252, 255, 588/3, 4; 106/815, 628, 717, 782

[56] References Cited

U.S. PATENT DOCUMENTS

| | | | |
|---|---|---|---|
| 3,507,801 | 4/1970 | Kausz et al. | 252/626 |
| 4,036,655 | 7/1977 | Yamada et al. | 106/77 |
| 4,122,028 | 10/1978 | Iffland et al. | 252/628 |
| 4,210,619 | 7/1980 | Haley | 264/140 |
| 4,293,437 | 10/1981 | Taponier et al. | 252/628 |
| 4,379,081 | 4/1983 | Rootham et al. | 252/628 |
| 4,500,449 | 2/1985 | Kuhnke et al. | 252/628 |
| 4,533,395 | 8/1985 | Vejmelka et al. | 106/89 |
| 4,620,947 | 11/1986 | Carlson | 252/628 |
| 4,664,895 | 5/1987 | McDaniel | 423/277 |
| 4,671,897 | 6/1987 | Mori et al. | 252/628 |
| 4,800,042 | 1/1989 | Kurumada et al. | 252/628 |
| 4,804,498 | 2/1989 | Mizuno et al. | 252/628 |
| 4,906,408 | 3/1990 | Bouniol | 252/628 |

FOREIGN PATENT DOCUMENTS

| | | | |
|---|---|---|---|
| 88587A | 3/1982 | European Pat. Off. | 106/628 |

*Primary Examiner*—Ngoclan Mai
*Attorney, Agent, or Firm*—Burns, Doane, Swecker & Mathis

[57] ABSTRACT

The present invention discloses a method for preparing the inorganic hardenable slurry and the use of same in the solidification of wastes. In addition to water, the essential parts of the slurry are inorganic components including borates, cement-base powder and other additives such as magnesium oxide, gypsum and silica. The slurry is low in viscosity before solidification and flows freely,and within approximately 30 minutes after preparation the slurry becomes hardened into a highly solidified substance. The solidification of the slurry is resulted mainly from reaction of borates and the cement-base powder and to obtain a best result the weight of borates must be the same as that of the cement-base powder or even higher than the weight of the latter. The solidification mechanism differs entirely from the simple hydration reaction that brings about solidification of cement.

The present invention also teaches a method for solidifying wastes with this hardenable slurry, i.e. to proceed solidification by admixing the various radioactive or non-radioactive dry and wet wastes with the hardenable slurry, or by burying waste pellets with the slurry. The solidified waste form thus obtained has a higher strength and the volume efficiency of the solidification is 2.5 to 10 times that of the conventional cement solidification. When applied to the solidification of low level radioactive wastes, the present method produces especially a tremendous economic efficiency.

12 Claims, No Drawings

PREPARATION OF INORGANIC HARDENABLE SLURRY AND METHOD FOR SOLIDIFYING WASTES WITH THE SAME

BACKGROUND OF THE INVENTION

In the final step of treatment of low level radioactive wastes (LLW) generated in the nuclear power plants, it is generally to make the waste into solid form which is then transported to an intermediate storage site for interim storage, or directly to a final disposal site for final disposal. Solidification is the most important step in the treatment processes, it is to confer upon the wastes long-term chemical and physical stabilities and to offer a higher strength to facilitate transportation and management. Since, solidification process determines the volume of the solidified waste, when the final disposal cost is mainly determined by the volume of the waste form, the over-all cost of the management is consequently again determined principally by the volume efficiency of solidification. Currently, among the solidification methods for LLW, the most frequently used are the three methods of cement solidification, plastic solidification and bitumen solidification, each of the three methods having its own advantages and disadvantages. Generally speaking, the cementitious waste form possesses excellent long-term stability; however, the cement solidification method has a low volume efficiency. On the other hand, while volume efficiency of the plastic solidification method is high and the plastic-solidified waste form possesses a high strength, its long-term stability remains, however, doubtful. Again, in the bitumen solidification method the volume efficiency is high, the strength of the bitumen-solidified waste form is, nevertheless, low and the waste form is also flammable. The current solidifications methods are, therefore, still far from perfection and in many areas need for improvements. Judging from the nature of these solidification methods, the long-term stability of the cement-solidified waste form communicates to the mind of people a very important security in relation to the storage requiring a period of over several hundred years. Hence, it has become a very urgent task to improve the volume efficiency of the cement solidification method in order to reduce the over-all cost in the management of LLW.

SUMMARY OF THE INVENTION

Accordingly, it is the purpose of the present invention to disclose a method for preparing a hardenable slurry in which the solidifying agent used is an inorganic cement-base powder whereby the solidified waste form has a long-term stability. The hardenable slurry may be utilized in the solidification of various radioactive and non-radioactive wastes of any form, the volume efficiency of solidification depending on kinds of the wastes can be as high as 2.5 to 10 times the conventional cement solidification method.

DETAILED DESCRIPTION OF THE INVENTION

In the waste solidification with cement, the monolith formed by the hydration of cement is used in packaging and burying the wastes.

The components of a cement, taking the known Portland cement as an example, principally consist of tricalcium silicate ($3CaO \bullet SiO_2$, or abbreviated to $C_3S$), dicalcium silicate ($2CaO \bullet SiO_2$, $C_2S$), tricalcium aluminate ($4CaO \bullet Al_2O_3 \bullet F_2O_3$, $C_4AF$) and a small amount of magnesium oxide, titanium oxide, sodium oxide and ferric oxide. The solidification of cement is essentially brought about by hydration of the above mentioned principal components, the reaction being as follows:

$$2C_3S+6H_2O=3CaO \bullet 2SiO \bullet 3H_2O+3Ca(OH)_2 \quad (1)$$

$$2C_2S+4H_2O=3CaO \bullet 2SiO_2 \bullet 3H_2O+Ca(OH)_2 \quad (2)$$

$$C_3A+12H_2O+Ca(OH)_2=3CaO \bullet Al_2O_3 \bullet Ca(OH)_2 \bullet 12H_2O \quad (3)$$

$$C_4AF+10H_2O+2Ca(OH)_2=6CaO \bullet Al_2O_3 \bullet Fe_2O_3 \bullet 12H_2) \quad (4)$$

Equation (1) being the hydration reaction of $C_3S$ represents the fastest among the above mentioned four types of hydration reaction and therefore constitutes the early hardening action, in which the release of hydration heat is also very obvious. Equation (2) is the hydration reaction of $C_2S$, in which the rate is slower and following the reaction the strength gradually increases. The colloids of 3CaO, $2SiO_2$ produced in the two reactions (1) and (2) possess cementation action capable of solidifying other particulates. Equations (3) and (4) represent hydration reactions of $C_3A$ and $C_4AF$, respectively, the calcium hydroxide required in the respective reactions being produced in the hydration reactions of Equations (1) and (2).

When cement is used for solidification of the liquid borate waste generated during the operation of PWR nuclear power plants, generally, the liquid waste is first neutralized with NaOH to a pH of 7 to 11 and is then concentrated into a solution containing 20,000–40,000 ppm boron. Cement is added into the solution for mixing so that solidification takes place.

In the presence of borate, the components of calcium oxide that are dissolved out from the cement particulates will form with borate into a crystal film of calcium borate ($CaO \bullet B_2O_3 \bullet nH_2O$). This crystal film forms a coating on the surface of the cement particulates and prevents the cement components from dissolving out thereby retarding the hydration action of the cement, so that the hardening action of cement stops. Therefore, when using cement to solidify the liquid borate wastes, lime is generally added to first react with borate to thereby control the formation on the surfaces of the cement particulates of the crystalline film of calcium borate. Although the method serves to reduce obstacles to the above mentioned solidification reaction of cement, it does not however completely stop them and the hardening time required for solidifying borate wastes is still several times that for solidifying other wastes. Besides, the method also presents some other drawbacks which are: (1) in the solidified form the weight of boric acid does not go beyond 10%, taking for example, the solidification of a 12% borate waste solution in which 1 $m^3$ waste solution produces approximately 2 $m^3$ of solidified waste form, and (2) the addition of lime while increasing volume of the solidified waste reduces the volume efficiency of the solidification. The other modified method for solidifying liquid borate wastes with cement has been jointly developed by the Japanese firm, Japan Gasoline Co. and the French firm, SGN Company. According to this method, a required amount of slaked lime is initially added to a borate waste solution and the solution stirred at 40°–60° C. for long hours (10 hrs.) so that borates are converted into insoluble calcium borates. The slurry so obtained is filtered and the filtrate after having been evaporated and concentrated is then mixed with filtered cake and cement for solidification. Accordingly, the method has avoided the aforesaid retardation of solidification as a result of the production of calcium borate crystalline film on cement particulates and the volume efficiency of solidification is also high; the treatment of 1 $m^3$ 12% borate waste solution producing approximately 1/3.5 $m^3$ solidified waste form. Nevertheless, because the treatment procedure and the equipment according to the method are more complicated, it has been the drawback that the fixed investment and the operation cost far exceed those by the conventional cement solidification method.

In order to solve the problems existing in the solidifying of borate waste solutions, the invention has achieved the following aims: (1) use of inexpensive inorganic solidifying agent for solidification, (2) a high volume efficiency, (3) simple equipments, (4) easy operation and (5) solidified waste forms meeting the acceptance criteria of quality. After numerous attempts and experiments, it has been finally accomplished by the present invention to develop a method for preparation of a hardenable slurry entirely from inorganic chemical compounds and a cement-base powder, which not only can be used in the solidification of liquid borate waste is also useful in the solidification of the ordinary nonradioactive dry and wet wastes satisfactorily attaining the foregoing five aims.

In the above, it has been described that a hard coating crystalline film of $CaO \bullet B_2O_3 \bullet nH_2O$ is formed on the surface of cement particulates when borate is present in the cement slurry. This coating film also prevents the hardening action of the cement. In fact, the present invention reflects a breakthrough in conception and has skillfully used this phenomenon of production of crystalline film for the completion. By this breaking-through conception, a hard crystal is permitted to be formed all-around and not merely limitted to formation on surfaces of the cement particulates, that is, it permits that hard crystal to be formed as the main structure part of the solidified substances and not merely a thin film. Through numerous experiments it has now been discovered that said aims can be achieved under the conditions of a high borate concentration and a high weight ratio of borate to cement. A high concentration of borate solution has been found to proceed in a fast and exothermic reaction with the cement-base powder and rapidly solidify to form a firm crystalline solid body. When weight % of the borate has reached a certain level, its solidification mechanism is entirely different from the hardening mechanism of the conventional cement solidification, the firm crystalline solids formed by the reaction are no longer only to cover on the surfaces of the cement granulates but to form a hard main body structure. The formation of such a firm structural body can be possible only when a high concentrated borate solution is used. The concentration of borate at least must be 50 weight %, preferably above 60 wt %. Borate has a rather low solubility in water; in order to attain a higher borate concentration, it is necessary to adjust appropriately the molar ratio of sodium/boron in the borate solution. Generally, the sodium/boron molar ratio in the solution is perferred to be within the range of 0.15 to 0.55, more preferably to be about 0.29 to 0.32. Under suitable conditions, the concentration of borate may be above 70 weight % and there will still be no crystallization at 40° C. It is also possible to carry out solidification of an over-saturated solution containing boric acid or borate crystals. However, consideration must be had as to other possible difficulties resulted, for example, problems such as blockage in pipe lines and uneven dispersion of the boric acid and borate crystals. Due to a rather fast hardening reaction, it is necessary therefore to use a stirring equipment which not only has a fast rotating speed but also permits a good dispersion of the cement-base powder, so that there is no partial formation of granulates having a higher content of cement component thus effecting the homogeneity and strength of the solidified waste forms on account of improper dispersion of the cement-base powders. Although a borate solution of high concentration is used according to the invention, the borate after having properly mixed with the cement-base powder forms, however, a slurry having a very good flowability. This slurry is readily stirrable before hardening and can easily pour and grout. Experiments revealed that use of borate of a high concentration is advantageous to strength of the solidified waste form, and hence the amount of water used need not be higher than the level where free standing water is produced. At the situation where there is no problem with the stirring and mixing, no other water need to be added in addition to the water content in the borate waste solution. Experimental results also indicate that once the amount of water used reaches the level where free standing water is produced, the solidified waste forms thus obtained come to have an undesirable quality. The properly mixed slurry will lose its flowability in about 10–30 mins and harden to form solid bodies depending on formulations: the higher the weight ratio of cement in the slurry, the faster will be the hardening. Taken Portland cement as an example, the weight ratio of cement/borate must be between 0.2 to 1.2, preferably between 0.4 to 0.7. If this ratio is too low, no hardening of slurry takes place; however, if the ratio is too high, the speed of hardening will be very fast. As a result, operation will become very difficult and the quality of solidified waste forms less desirable. Besides the Portland cement, there are other types of cement-base powders or cement analogs, such as, blast furnace slag, fly ash, or mixtures thereof, which may also be used.

In addition to cement-base powders, any additives which are capable of promoting quality of the solidified waste forms of the present invention may be appropriately added to. Oxides of mono- to tetra- valence metals or powders of their salts, such as silica magnesium oxide and gypsum are very good additives. To take, for example, the addition of silica, if silica is initially added into the borate solution and, which after stirring for some time, is next added cement-base powder, the mixture on hardening then has a low rate of heat generation. As a result, the time of hardening can be delayed and is advantageous to the proper mixing process. This has also been shown by experiments that addition of silica in appropriate amount allows the solidified waste forms to possess a higher compressive strength and water-immersion resistance. Silica may be added in amount higher than the cement-base powder and may reach 1.5 times the weight of the cement-base powder, preferably 0.9 to 1.1 times. Furthermore, after adding of silica the amount of cement-base powder used may be reduced accordingly.

Since the solidification according to the present invention proceeds rapidly, it will be most suitable to perform solidification by in-drum mixing. To avoid trouble with cleaning the stirrer, this is even suitable with the use of a disposable type of stirrer which, after completing the stirring performance, stays behind in the solidified waste form.

The strength of the solidified waste form according to the invention may be reinforced by addition of various fibrous reinforcement additives such as graphite fiber, glass fiber, steel fiber and other kinds of reinforcing fiber. In addition to a reinforcement function on structure, these fibrous reinforcing agents are also effective in assisting dispersion of the cement-base powder, promoting completion of the solidification, enhancing homogeneity of the solid components and improving strength of the solidified waste forms, if they were added into borate solution prior to the addition of the cement-base powder.

The hardenable slurry composition of the present invention, in addition to being used in solidifying the borate waste solution, is also useful as a solidification agent in solidifying the other wastes. In one manner of the uses, a hardenable slurry is prepared, as described in the above, from sodium borate, cement-base powder and the additive. The sludge or liquid wastes to be solidified are then mixed with the slurry and solidified waste forms are obtained after solidification of the slurry. In another way, the sludge and liquid wastes are concentrated, dried and then pelletized. The pellets obtained are then immersed and buried in the hardenable slurry, which on hardening gives solid waste forms with embedded waste pellets. Because the hardenable slurry has a very low viscosity, for handling immersion and burying of the waste pellets, any one of the methods, by either pouring the waste pellets into the slurry or the slurry into the waste pellets drum, may be followed.

The solidification process of the present invention is suited for use in solidification of any wastes that will not prevent hardening of the slurry, for instance, in the solidification of LLW generated in BWR nuclear power plants, such as: sodium sulfate waste solution, waste sludge containing powdery resin, furnace clinkers or ash from incinerator and other nonradiative industrial wastes. The solidified waste form so obtained has a quality far higher than the acceptance criteria of quality set forth for the solidified low level radioactive waste forms by the U.S. Nuclear Regulatory Commission, as shown in Table 1, and an especially high volume efficiency for solidification. For example, when the method is used in solidifying LLW, the weight of borates in the solidified waste form may be as high as 60 wt % during the solidification of borate waste solution; when used in solidifying sodium sulfate wastes the percentage may also reach 60 wt % and in solidification of powdery resin it attains 15 wt %. The volume efficiency, on comparison with the conventional cement solidification, is approximately 8, 10 and 2.5 times, respectively, of the latter and the invention, hence, is of a great industrial utility value.

TABLE 1

Quality specification for low level radioactive waste solid forms according to the acceptance criteria of quality set forth by the U.S. Nuclear Regulatory Commission:

| Test Item | Compressive Strength $Kg/cm^2$ | Compressive Strength after rad. irradiation $kg/cm^2$ | Leachability index after and before rad. irradiation | Compressive Strength after 90 days water immersion $kg/cm^2$ | Compressive Strength after 30 cycles thermal cycling test $kg/cm^2$ |
|---|---|---|---|---|---|
| Testing Method | ASTM C39 | ASTM C39 | ANS 16.1 | ASTM C39 | ASTM B533 |
| Acceptance Criteria of Quality | >15 | >15 | >6 | >16 | >15 |

The following examples will explain the invention without limiting it.

EXAMPLE 1

Solidification of Borate Solution 1305 g boric acid were put into a beaker containing 540 g of water, the water was stirred to allow dispersion of the boric acid powders in it. Next, 255 g NaOH were added slowly into the beaker, the boric acid powders on reaction with the dissolved sodium hydroxide produce sodium borate and were gradually dissolved. The resulting clear solution was a solution containing a molar ratio of sodium: boron of 0.3, pH of about 7.2 and 62 wt % of borate.

The above solution was cooled to 40° C. and next poured into a 5 l.cement blender, 900 g of a cement-base powder, STA, obtained from Taiwan Cement Corp., containing 24% $SiO_2$, 8% $Al_2O_3$, 54% CaO, 2% $Fe_2O_3$, 2.5% MgO and 6.5% $SO_3$, were added slowly under stirring and stirred sufficiently to allow homogeneous dispersion of the powders. The slurry after proper mixing was next grouted in polyethylene mold to make cylindrical solid samples having a diameter of 5 cm and height of 10 cm. The slurry upon mixing showed a slight rise in temperature and on grouting into mold the slurry was found to be freely flowable. This slurry, however, was hardened forming a monolithic solid form in about 10 mins.

A total of 20 solid form specimens was made according to the above steps. The specimens were placed in room and respectively on 14, 30 and 90 days after grouting into mold, five specimens each as a group were taken for test, results obtained show that the average compressive strength of the specimen groups was 48.86, 55.91, and 62.49 $kg/cm^2$ respectively and the specific gravity of the specimen was 1.7.

EXAMPLE 2

The experimental procedure of Example 1 was repeated, in which Portland type II cement was substituted for the STA cement-base powder. The results obtained show that the compressive strength of the specimen on 14, 30, and 90 days thereafter was 54.28, 70.19, and 76.06 $kg/cm^2$, respectively.

EXAMPLE 3

The experimental procedure of Example 1 was repeated, in which $SiO_2$ powder and/or chopped graphite fiber (Hercules 1900/AS) were first added prior to the addition of the cement-base powders in part of the experiment. The mixture was stirred for 5 mins and into which was next added cement-base powders. Samples of the solid form specimen so made were left in a room for 14 or 30 days and thereafter tests were carried out. Results of the test and detail of the solidification preparation were shown as in Table 2. The results show that $SiO_2$ and graphite fiber clearly reinforced the solid form specimen; qualities of all the specimens tested were much superior to acceptance criteria of the quality of solidified low level radioactive waste form set forth by the US NRC regulation.

TABLE 2

| Preparatory ratio and characterization results of solidification experiment on simulative liquid borate waste | | | | | | | | | | | |
|---|---|---|---|---|---|---|---|---|---|---|---|
| Component weight (g) | | | | | | Compressive strength ($kg/cm^2$) | | | | | |
| Boric acid | NaOH | Cement-base powder | Water | Fume silica | Graphite fiber | Original (curing time) | After $10^8$ rad irradiation | After 90 days water immersion | After thermal cycling test (−10 to +60° C. 30 cycles) | Leachability index Co | Leachability index Cs |
| 1400 | 288 | STA 450 | 600 | 400 | 0 | 69.6 (30 days) | | 62.68 | 86.61 | | |
| 1400 | 288 | STA 450 | 600 | 400 | 4.58 | 122.5 (14 days) | | 69.16 | | | |
| 1400 | 288 | STA 450 | 600 | 400 | 11.44 | 142.6 (14 days) | 63.88 | 73.36 | 48.50 | | |
| 1400 | 288 | PL-II 450 | 600 | 400 | 4.58 | 146.2 (14 days) | | 135.46 | | | |
| 1400 | 288 | PL-II 450 | 600 | 400 | 11.44 | 205.0 (14 days) | 179.94 | 127.46 | 159.42 | | |
| 1305 | 255 | STA 900 | 540 | 0 | 4.20 | 111.6 (30 days) | 101.3 | 38.56 | 125 | | |
| 1305 | 255 | STA 900 | 540 | 0 | 10.50 | 155.4 (30 days) | 147.22 | 69.68 | 184.2 | | |
| 1305 | 255 | PL-II 900 | 540 | 0 | 4.20 | 83.6 (30 days) | 102.06 | 70.16 | 64.4 | 12.5 | 8.3 |
| 1305 | 255 | PL-II 900 | 540 | 0 | 0 | 70.2 (30 days) | 72.8 | 34.73 | 51.4 | 12.6 | 8.6 |
| 1305 | 255 | PL-II 900 | 540 | 300 | 0 | | | | | 12.8 | 10.2 |

Note: 1.STA denotes the cement-base powder having a composition as described and used in Example 1; PL-II denotes the portland II cement.
2.The characterization was made following the test method of the US NRC Technical Position on Waste Form (Revision 1), Jan. 1991.

EXAMPLE 4

Experiments similar to Example 1 were repeated, and in which $Na_2SO_4$ powders were added immediately after cement-base powders were added and homogeneously dispersed and a slurry was prepared. Process of mixing was continued until it became homogeneous, when the slurry was grouted into mold and solid form specimens with a diameter of 5 cm and height of 10 cm were made. The experiments demonstrated solidification of $Na_2SO_4$ with a hardenable slurry prepared from borate and the cement-base powders. The preparatory ratio of components in the experiments and compressive strength of solid forms were shown as in Table 3.

TABLE 3

| Preparatory ratio of components and tests on $Na_2SO_4$ solidification experiments | | | | | | |
|---|---|---|---|---|---|---|
| $H_3BO_3$ g | NaOH g | $H_2O$ g | Cement-base powders g | $Na_2SO_4$ g | Compressive strength $kg/cm^2$ | Curing time |
| 1305 | 255 | 540 | STA 900 | 1300 | 180 | 1 day |
| 1305 | 255 | 540 | STA 900 | 2000 | 270 | 1 day |
| 1305 | 255 | 540 | STA 900 | 3000 | 286 | 1 day |

EXAMPLE 5

Experiments similar to Example 4 were repeated only in that, during operation incinerator slag obtained from the incinerator of the Taiwan Power Corporation were substituted for $Na_2SO_4$ powders. The experiments demonstrated the solidification of incinerator slag with the hardenable slurry prepared from borate and the cement-base powders. The preparatory ratio of components in the experiments and test results were shwon as in Table 4.

TABLE 4

| Preparatory ratio of components in the experiments and test results | | | | | | |
|---|---|---|---|---|---|---|
| $H_3BO_3$ g | NaOH g | $H_2O$ g | Cement-base powders g | Slag g | Compressive strength $kg/cm^2$ | Curing time |
| 1305 | 255 | 540 | PL-II 900 | 600 | 71.5 | 1 day |
| 1305 | 255 | 540 | PL-II 600 | 1500 | 100.7 | 1 day |
| 1305 | 255 | 540 | PL-II 700 | 1867 | 112.1 | 1 day |

EXAMPLE 6

Experiments similar to Example 4 were repeated but with dried powdery resin in substitution for $Na_2SO_4$ powders. The experiments demonstrated the solidification of powdery resin with the hardenable slurry prepared from borate and the cement-base powders. The preparatory ratio of components in the experiments and test results were shown as in Table 5.

TABLE 5

| Preparatory ratio of components in the experiments and test results | | | | | | |
|---|---|---|---|---|---|---|
| $H_3BO_3$ g | NaOH g | $H_2O$ g | Cement-base powders g | Dry powdery resin g | Compressive strength $kg/cm^2$ | Curing time |
| 1305 | 255 | 540 | PL-II 900 | 450 | 127.5 | 1 day |

We claim:

1. A hardenable slurry composition comprising dissolved borate, suspended cement-base powder and water, wherein the weight ratio of cement-base powder is between 0.2 and 1.2 times the weight of the borate and wherein the total water content of the composition is below 40 wt. %.

2. A hardenable slurry composition of claim 1, wherein the borate is sodium borate and the molar ratio of sodium/boron in the slurry is between 0.15 and 0.55.

3. A hardenable slurry composition of claim 1, further including oxides of mono- to tetra-valence metals or powders of their salts.

4. A hardenable slurry composition of claim 3, wherein the sum of weights of metal oxides and salts and cement-base powder is between 0.2 and 1.2 times the weight of the borate.

5. A hardenable slurry composition of claim 3, wherein the metal oxide so added is magnesium oxide.

6. A hardenable slurry composition of claim 3, wherein the metal oxide so added is silicon dioxide.

7. A hardenable slurry composition of claim 3, wherein the metal salt powder so added is gypsum.

8. A hardenable slurry composition of claim 1, further containing a fibrous strength reinforcing agent.

9. A hardenable slurry composition of claim 1, further including at least one additive selected from the group consisting of silicon dioxide, magnesium oxide, blast furnace slag, fly ash, and mixtures thereof.

10. A process for solidifying wastes, the solidification product of which is formed by hardening a hardenable slurry comprising dissolved borate, suspended cement-base powder and water, wherein the weight ratio of cement-base powder is between 0.2 and 1.2 times the weight of the borate and wherein the total water content of the composition is below 40 wt. %.

11. A process for solidifying wastes as claimed in claim 10, wherein the wastes are directly mixed with the hardenable slurry and solidified.

12. A process for solidifying wastes as claimed in claim 10, including the steps of drying the wastes to form solid powders, particulates or pellets and embedding the dried wastes in the hardenable slurry prior to solidification.

* * * * *